US005787591A

United States Patent [19]

Lu

[11] Patent Number: 5,787,591

[45] Date of Patent: Aug. 4, 1998

[54] KNIFE BLADE EDGE

[75] Inventor: Keh Jeno Lu, Taipin Hsiang Taichung, Taiwan

[73] Assignee: Long Shye Enterprise Co., Ltd., Taipin Hsiang Taichung, Taiwan

[21] Appl. No.: 876,201

[22] Filed: Jun. 16, 1997

Related U.S. Application Data

[63] Continuation of Ser. No. 682,963, Jul. 18, 1997, abandoned.

[51] Int. Cl.[6] ..... B26B 9/02

[52] U.S. Cl. ..... 30/355; 30/356; 30/357

[58] Field of Search ..... 30/355, 356, 357

[56] References Cited

U.S. PATENT DOCUMENTS

| | | | |
|---|---|---|---|
| 378,203 | 2/1888 | Lohman | 30/357 |
| 437,325 | 9/1890 | Barclay | 30/355 |
| 495,110 | 4/1893 | Hayes et al. | 30/355 |
| 556,615 | 3/1896 | Campbell | 30/357 |
| 877,146 | 1/1908 | Ward | 30/357 |
| 1,388,547 | 8/1921 | Burns | 30/357 |
| 1,489,419 | 4/1924 | Beechlyn | 30/357 |
| 2,279,833 | 4/1942 | Madan | 30/356 |
| 2,555,735 | 6/1951 | Estabrooks | 30/357 |
| 2,803,876 | 8/1957 | Nelson | 30/357 |
| 2,834,108 | 5/1958 | Thompson | 30/355 |
| 3,279,065 | 10/1966 | Senkewitz | 30/355 |
| 4,907,344 | 3/1990 | Hahn | 30/357 |

FOREIGN PATENT DOCUMENTS

| | | | |
|---|---|---|---|
| 951476 | 10/1949 | France | 30/355 |
| 1208845 | 2/1960 | France | 30/355 |
| 322398 | 12/1929 | United Kingdom | 30/355 |
| 608685 | 9/1948 | United Kingdom | 30/357 |

*Primary Examiner*—Hwei-Siu Payer
*Attorney, Agent, or Firm*—Bacon & Thomas

[57] ABSTRACT

A knife blade has an edge provided with a recessed portion of a wavy profile and extending from the heel to the tip of the blade. The recessed portion of the edge is composed of a plurality of thick segments and thin segments. The thick segments press against the sides of an incision of the cut surface such that the thin segments and the cut surface form a plurality of gaps to accommodate air or fluid so as to prevent the sides of the incision of the cut surface from attaching to sides of the edge.

6 Claims, 6 Drawing Sheets

KNIFE BLADE EDGE

This application is a Continuation of application Ser. No. 08/682,963, filed Jul. 18, 1997, now abandoned.

FIELD OF THE INVENTION

The present invention relates generally to a knife blade, and more particularly to an edge of the knife blade.

BACKGROUND OF THE INVENTION

The conventional knife is generally defective in design in that its blade edge is not constructed to facilitate the easy cutting of food items such as the cooked meat containing fat, the cake, and the like. The cooked meat, such as beef, is generally composed of a certain amount of fat in addition to muscles. The cooked meat cannot be therefore cut easily with the conventional knife in view of the fact that the fat contained in the cooked meat can cause the skidding of the knife blade. Similarly, the cake cannot be cut easily with the conventional knife. It is familiar to most people that the cake is often attached to the knife blade to make the cutting of cake a rather messy job.

Such a conventional knife as described above is improved in such a manner that the knife blade is provided with a serrated edge to facilitate the cutting of meat; nevertheless it has failed to solve the problems that are often encountered with the cutting of cake and the like.

SUMMARY OF THE INVENTION

The primary objective of the present invention is therefore to provide an improved knife, which comprises a blade edge having a wavy recessed portion extending from the heel to the tip of the knife blade. The wavy recessed portion of the blade edge is composed of a plurality of thick segments and thin segments. In the process of cutting an object, the thick segments of the recessed portion of the blade edge are pressed against the cut surface of the object, so as to cause the internal tension of the object to straighten up the cut surface such that a gap is formed between the cut surface and the thin segments, and that the gap is filled with air to avert the formation of a vacuum effect, thereby preventing the cut object from being attached to the blade edge to obstruct the cutting process under way.

As the cutting process is under way, the thin segments of the blade edge are not in contact with the cut surface. As a result, the contact area between the blade edge and the object to be cut is reduced to an extent that the thick segments of the blade edge serve to open up the cut surface effectively to facilitate the easy cutting of the object.

The foregoing objective, features, functions, and advantages of the present invention will be more readily understood upon a thoughtful deliberation of the following detailed description of the embodiments of the present invention in conjunction with the accompanying drawings.

DETAILED DESCRIPTION OF THE PREFERRED EMBODIMENTS

Figure 1:
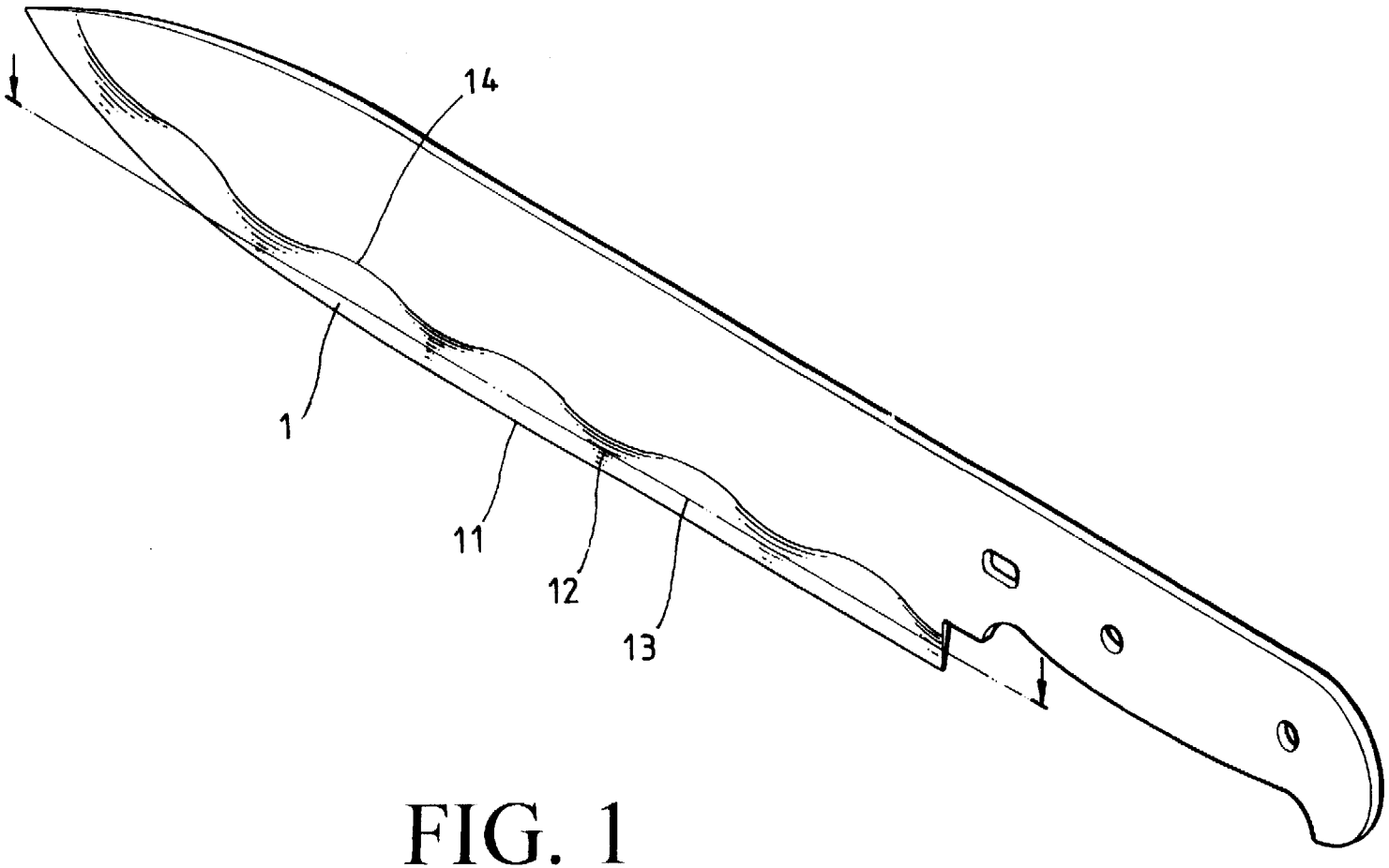
FIG. 1 shows a perspective view of the present invention.
Figure 2:
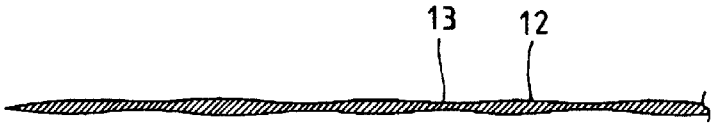
FIG. 2 shows a longitudinal sectional view of a blade edge of the present invention.
Figure 3:
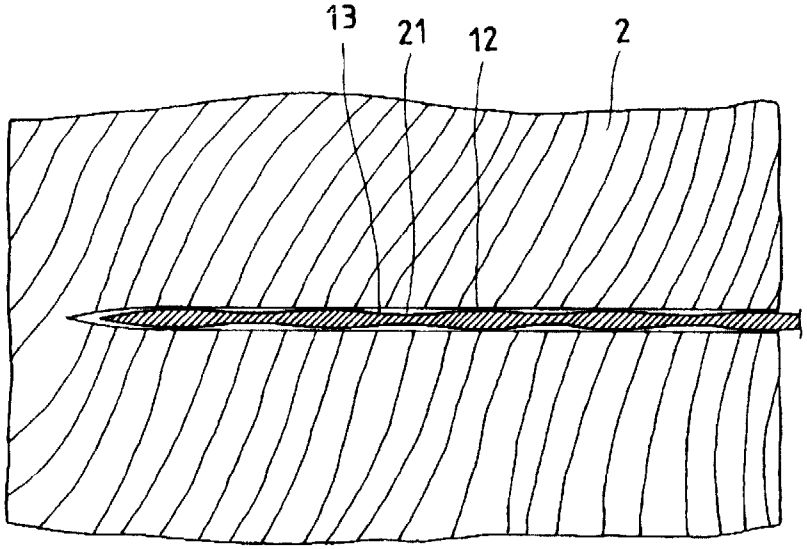
FIG. 3 is a schematic view illustrating the blade edge of the present invention at work.

As illustrated in FIGS. 1–3, a knife of the present invention comprises a blade 1 having a blade edge 11 for cutting an object 2. The blade edge 11 has a wavy recessed portion extending from the heel to the tip of the blade. The wavy recessed portion is made up of a plurality of thick segments 12 and thin segments 13, which are arranged alternately. The wavy recessed portion is defined by a wavy line 14.

As shown in FIG. 3, when the surface of the object 2 is cut open by the blade edge 11 of the present invention, both sides of the incision are pressed by the thick segments 12 of the blade edge 11. In the meantime, the internal tension of the object 2 works to straighten the cut surface of the object 2, thereby resulting in the formation of a plurality of gaps 21 located between the straightened surface and the thin segments 13 of the blade edge 11. The gaps 21 serve to accommodate air or fluid so as to avoid a vacuum effect which causes the cut surface of the object 2 to become attached to the blade 1. The attachment of the cut surface to the blade 1 can adversely affect the cutting process.

In addition, the contact area between the blade edge 11 and the cut surface of the object 2 is relatively small as compared with the conventional knife, in view of the fact that only the thick segments 12 of the blade edge 11 of the present invention make contact with the cut surface of the object 2. Furthermore, the thick segments 12 of the blade edge 11 serve to help open up the incision so as to facilitate the cutting of the object 2 with ease and speed.

Figure 4A:
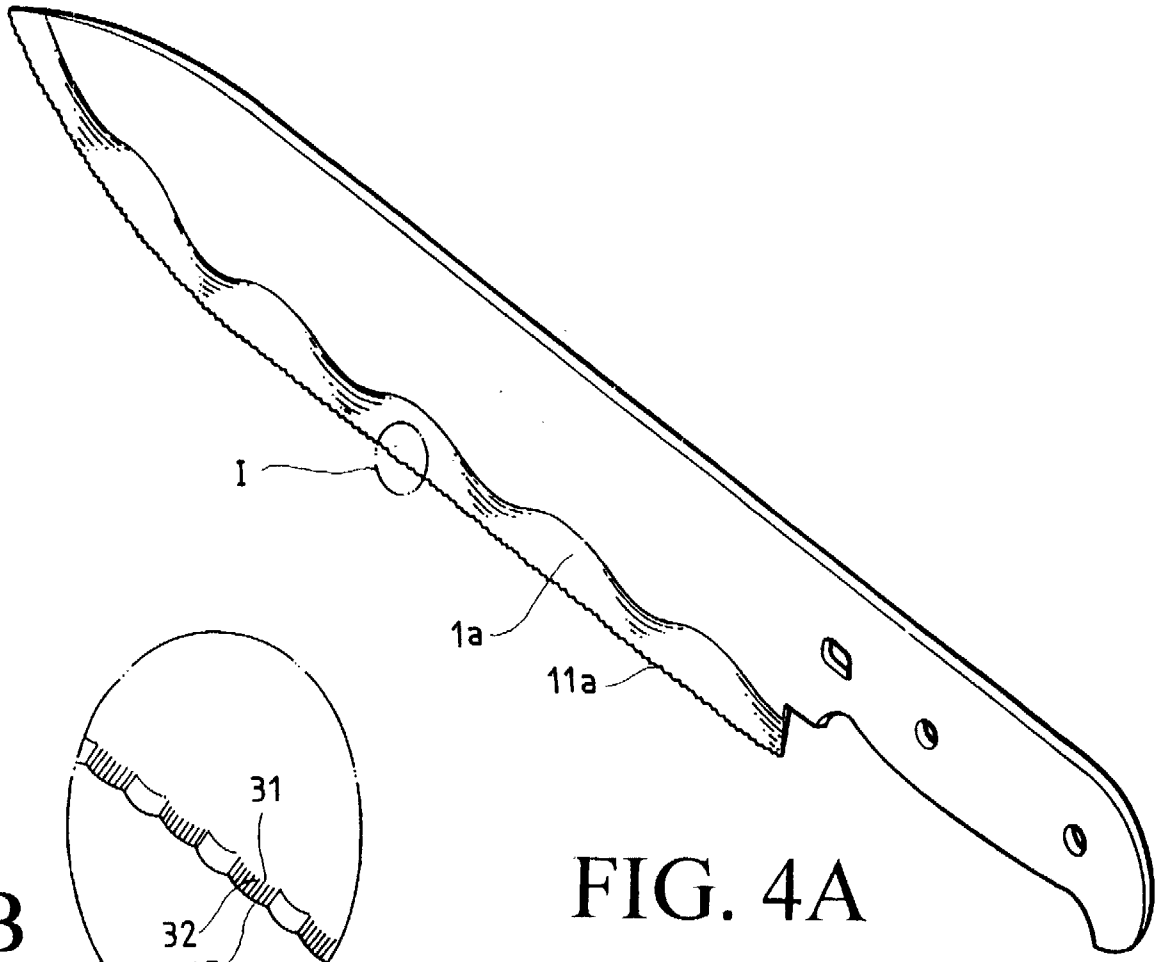
FIG. 4A shows a schematic view of a serrated blade edge of a first preferred embodiment of the present invention.
Figure 4B:
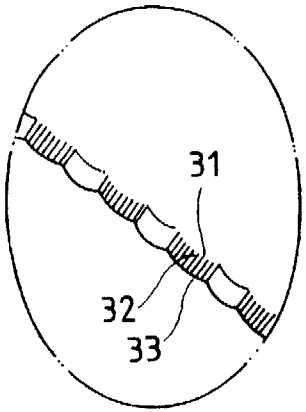
FIG. 4B is an enlarged view of area I in FIG. 4A.

As shown in FIGS. 4A and 4B, a knife blade of the first preferred embodiment of the present invention has a serrated edge, which is composed of a plurality of grooves 31 and ribs 32. Each of the grooves 31 has an arcuate end while each of the ribs 32 has a pointed end 33. The rib 32 is located between two grooves 31.

The knife blade **1*a* is more durable, thanks to the ribs 32 serving to reinforce the structural strength of the blade 1*a*. The pointed ends 33 of the ribs 32 are intended to reduce the resistance of the cut surface against the cutting action of the blade edge 11*a***.

Figures 5A, 5B:
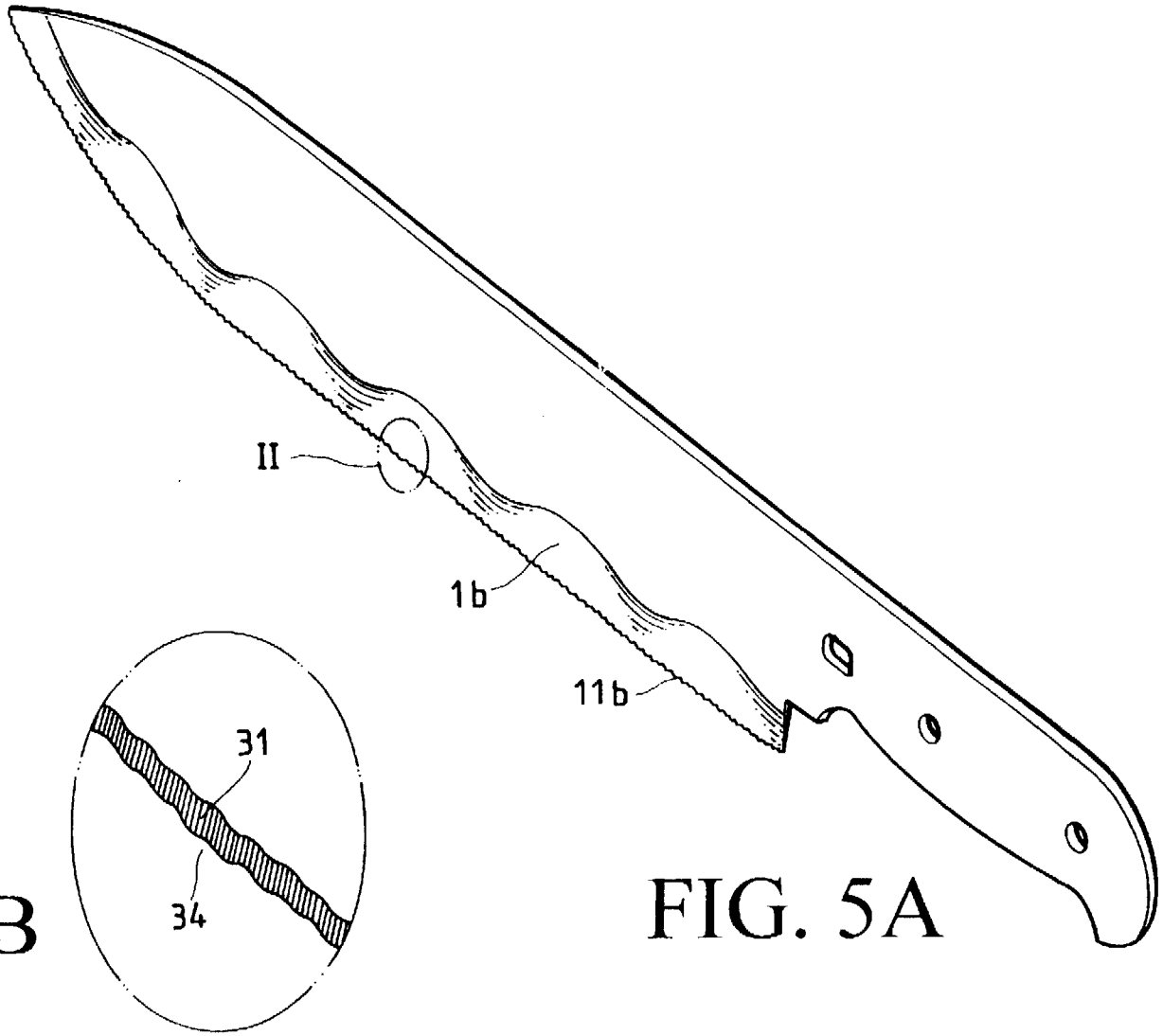
FIG. 5A shows a schematic view of a serrated blade edge of a second preferred embodiment of the present invention.
FIG. 5B is an enlarged view of area II in FIG. 5A.

As shown in FIGS. 5A and 5B, a knife blade **11*b* of the second preferred embodiment of the present invention has a blade edge 11*b* which is provided with a continuous groove 31 and a plurality of arcuate ends 34. The blade edge 11*b*** of the second preferred embodiment of the present invention is intended for use in cutting special food.

Figure 6A:
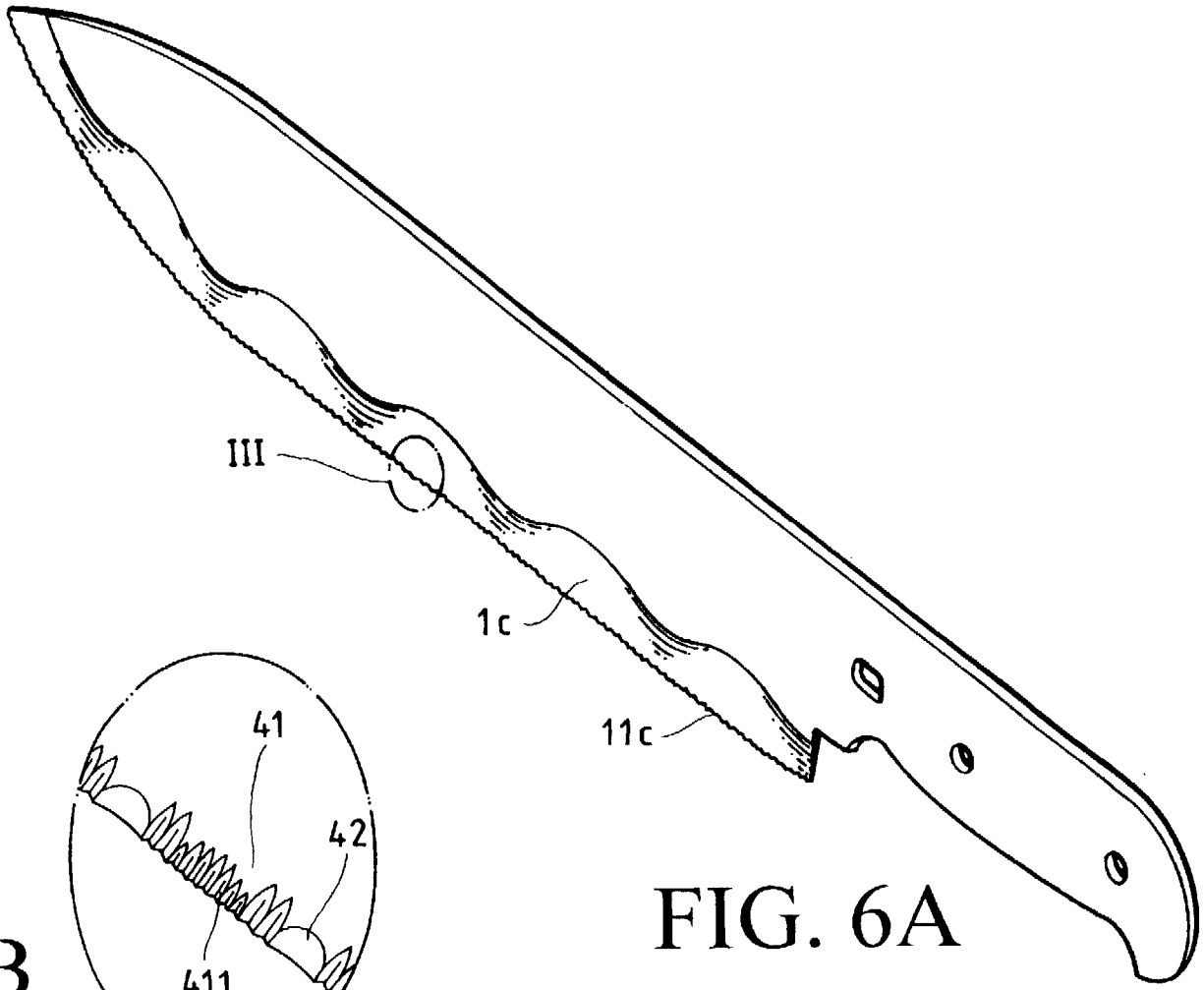
FIG. 6A shows a schematic view of a serrated blade edge of a third preferred embodiment of the present invention.
Figure 6B:
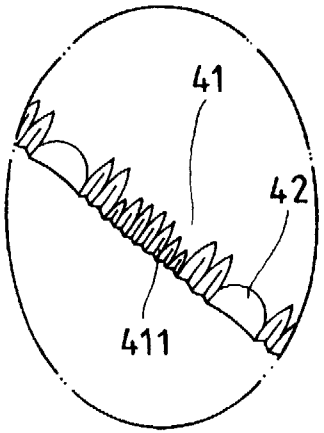
FIG. 6B is an enlarged view of area III in FIG. 6A.

As shown in FIG. 6A and 6B, a knife blade **1*c* of the third preferred embodiment of the present invention has a blade edge 11*c* which is composed of a plurality of cutting portions 41 and machining portions 42, which are arranged alternately. Each cutting portion 41 comprised a plurality of upright teeth 411. Each machining portion 42** is of an arcuate recessed construction.

The knife blade **1*c* of the third preferred embodiment of the present invention is intended for use in cutting beef which is considerably elastic. In the process of cutting beef, the elastic muscles of the beef can be accommodated in the machining portions 42 such that the teeth 411 of the cutting portions 41** can do the cutting job efficiently.

Figure 7A:
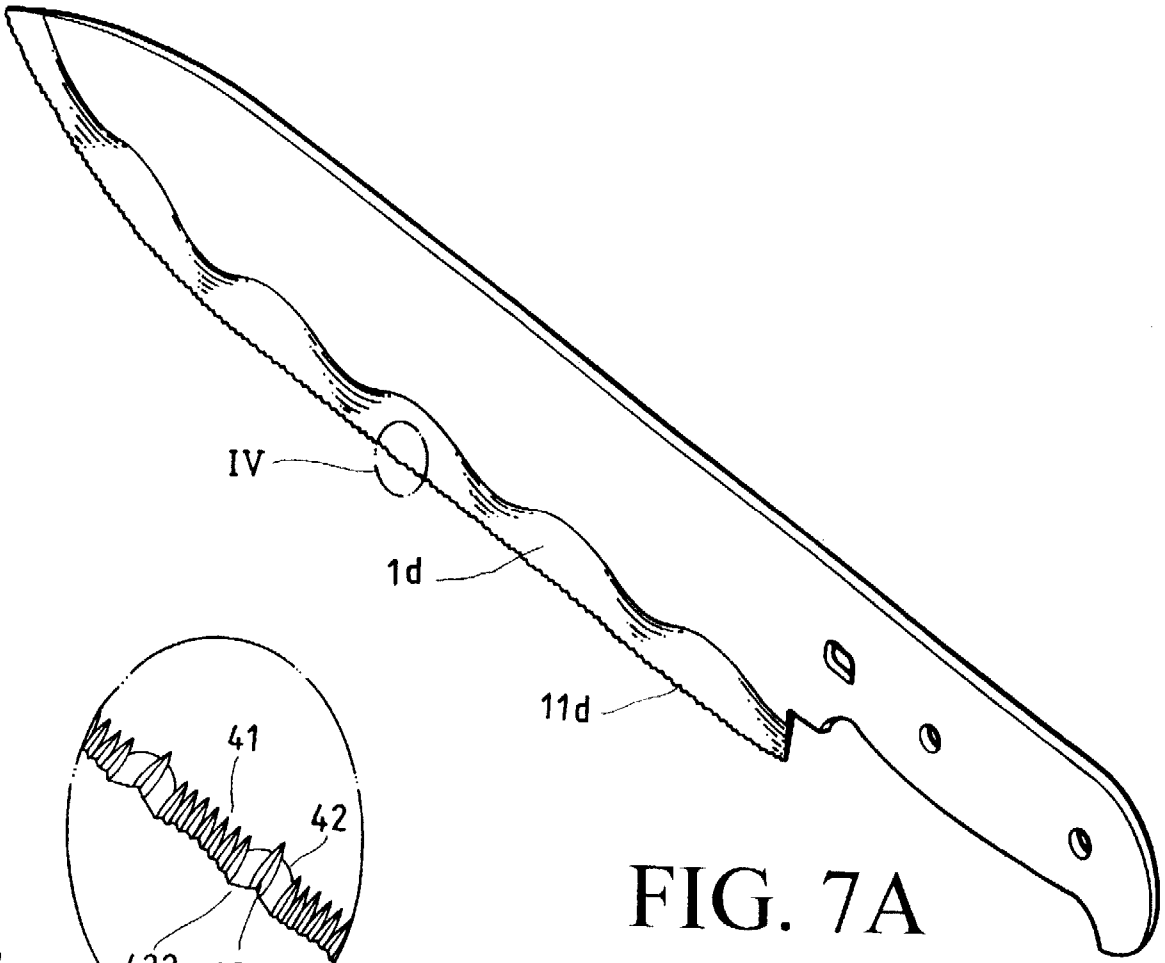
FIG. 7A shows a schematic view of a serrated blade edge of a fourth preferred embodiment of the present invention.
Figure 7B:
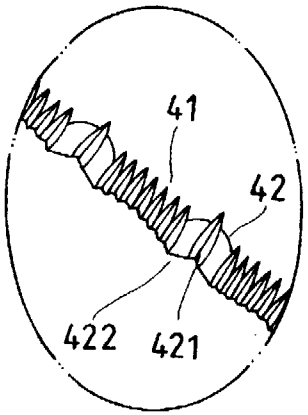
FIG. 7B is an enlarged view of area IV in FIG. 7A.

As illustrated in FIGS. 7A and 7B, a knife blade 1*d* of the fourth preferred embodiment of the present invention is basically similar in construction to the knife blade 1*c* of the third preferred embodiment of the present invention, except that the former has a blade edge 11*d* which is composed of a plurality of cutting portions 41 and machining portions 42, with each machining portion 42 having a tooth 421 located at the center and two miniedges 422 located respectively on the left-side and the right side of the tooth 421.

In the process of cutting beef, the initial cutting of beef is done by the miniedges 422 of the matching portions 42 while the deeper cutting of beef is brought about by teeth 421 of the machining portions 42. The final cutting of beef is attained by the cutting portions 41. While the final cutting of beef is under way by the cutting portions 41, the machining portions 42 serve to prevent the knife blade 1*d* from skidding.

The knife blade in any of the embodiments may have the thick and thin segments arranged alternately and they may also be equidistantly spaced apart. The thick segments may all have equal thicknesses, or they may have unequal thicknesses. Similarly, the thin segments may all have equal thicknesses, or the thicknesses may be unequal. Also, the thick segments may be symmetrical or asymmetrical without exceeding the usage of the invention.

The embodiments of the present invention described above are to be regarded in all respects as being merely illustrative and not restrictive. Accordingly, the present invention may be embodied in other specific forms without deviating from the spirit thereof. The present invention is therefore to be limited only by the scopes of the following appended claims.

What is claimed is:

1. A knife blade comprising:

a cutting edge for cutting an object;

a knife blade portion adjacent said cutting edge;

said knife blade portion having a length and two elongated non-parallel opposite sides adjacent said cutting edge;

at least one of said non-parallel opposite sides being undulated so that said undulated side and the other of said opposite sides forming a continuously varying thickness along said length;

said continuously varying thickness defining a plurality of maximum thicknesses and a plurality of minimum thicknesses;

each said maximum thickness being greater in thickness than that of each said minimum thickness;

whereby said maximum thicknesses bear against at least one side of an incision made by said cutting edge, and the minimum thicknesses are spaced from said at least one side of the incision so as to form a plurality of gaps to prevent said at least one side of the incision from attaching to said non-parallel sides of said knife blade portion.

2. The knife blade of claim 1 wherein the maximum and minimum thicknesses alternate along the length of the cutting edge.

3. The knife blade of claim 2 wherein the maximum and minimum thicknesses are equidistantly spaced along the length of the cutting edge.

4. The knife blade of claim 1 wherein the maximum thicknesses are all equal in thicknesses to each other.

5. The knife blade of claim, 1 wherein the minimum thicknesses are all equal in thicknesses to each other.

6. The knife blade of claim 5 wherein the maximum thicknesses are all equal in thickness to each other.

* * * * *